US007869909B2

(12) United States Patent
Harrison

(10) Patent No.: US 7,869,909 B2
(45) Date of Patent: Jan. 11, 2011

(54) STRESS MONITORING SYSTEM FOR RAILWAYS

(76) Inventor: Harold Harrison, 2623 Pear Point Rd., Friday Harbor, WA (US) 98250

( * ) Notice: Subject to any disclaimer, the term of this patent is extended or adjusted under 35 U.S.C. 154(b) by 1104 days.

(21) Appl. No.: 11/552,386

(22) Filed: Oct. 24, 2006

(65) Prior Publication Data

US 2007/0044566 A1 Mar. 1, 2007

Related U.S. Application Data

(63) Continuation-in-part of application No. 10/899,265, filed on Jul. 26, 2004, now Pat. No. 7,502,670.

(51) Int. Cl.

| | |
|---|---|
| ***G01L 1/04*** | (2006.01) |
| ***G01B 7/16*** | (2006.01) |
| *G01L 1/00* | (2006.01) |
| *G06F 17/00* | (2006.01) |

(52) U.S. Cl. ..... 701/19; 73/765; 73/774; 73/781; 73/767; 246/121; 324/209

(58) Field of Classification Search ..... 701/19; 246/121, 219, 120, 1 R; 73/781, 787, 774, 73/779, 760, 765, 769, 775, 767, 763, 582, 73/766; 324/209; 33/1 Q, 651; 104/307; 702/185

See application file for complete search history.

(56) References Cited

U.S. PATENT DOCUMENTS

| | | | | |
|---|---|---|---|---|
| 3,995,247 | A * | 11/1976 | Kurtz | 338/43 |
| 4,163,397 | A * | 8/1979 | Harmer | 73/800 |
| 5,529,267 | A * | 6/1996 | Giras et al. | 246/120 |
| 5,713,540 | A * | 2/1998 | Gerszberg et al. | 246/121 |
| 5,987,979 | A | 11/1999 | Bryan | |
| 5,992,241 | A | 11/1999 | Posgay et al. | |
| 6,125,708 | A * | 10/2000 | Wang et al. | 73/862.49 |
| 6,570,497 | B2 | 5/2003 | Puckette, IV et al. | |
| 7,392,117 | B1 * | 6/2008 | Bilodeau et al. | 701/19 |

(Continued)

FOREIGN PATENT DOCUMENTS

| | | | |
|---|---|---|---|
| JP | 2002236065 | A | 8/2002 |

(Continued)

OTHER PUBLICATIONS

International Search Report and the Written Opinion from PCT/US2005/026384, filed Jul. 26, 2005.

(Continued)

*Primary Examiner*—Thomas G Black
*Assistant Examiner*—Christine Behncke
(74) *Attorney, Agent, or Firm*—McNees Wallace & Nurick, LLC

(57) ABSTRACT

A rail stress monitoring system is disclosed. This system includes a sensor module that further includes a sensing device that is adapted to be mountable directly on a length of rail. The sensing device further includes a generally flat metal shim and at least one, and typically two or more, sensors mounted on one side of the shim. The sensors are typically strain gauges, which are mounted on the shim in a specific, predetermined configuration. At least one data acquisition module is in electrical communication with the sensing device and a data processing module receives and processes information gathered by data acquisition module.

8 Claims, 8 Drawing Sheets

U.S. PATENT DOCUMENTS

| | | | | |
|---|---|---|---|---|
| 2004/0025595 | A1 * | 2/2004 | Brennan | 73/787 |
| 2004/0122569 | A1 | 6/2004 | Bidaud | |
| 2006/0059992 | A1 * | 3/2006 | Jury | 73/579 |

FOREIGN PATENT DOCUMENTS

| | | | |
|---|---|---|---|
| WO | 2006014893 | A2 | 2/2006 |

OTHER PUBLICATIONS

"HPI—Weldable & Bondable Strain Gages", http://www.hitecprod.com/Html%20Pages/weld_bondSG.html, pp. 1-2.

"Hitec Products Catalog", 1997 Hitec Products Inc., Ayer, MA 01432, pp. TOC-12.

* cited by examiner

STRESS MONITORING SYSTEM FOR RAILWAYS

CROSS-REFERENCE TO RELATED APPLICATIONS

This patent application is a continuation-in-part of U.S. patent application Ser. No. 10/899,265 filed on Jul. 26, 2004 and entitled "System and Method for Determining Rail Safety Limits".

TECHNICAL FIELD OF THE INVENTION

The described systems and methods are generally related to information processing environments for monitoring longitudinal stresses in continuously welded steel rails ("CWR"). More specifically, the described systems and methods are related to processing monitored stress levels to determine limits of rail safety.

BACKGROUND OF THE INVENTION

Over the last forty years, an effort has been underway to eliminate the mechanical joints in railroad tracks. That effort has largely involved constructing tracks having continuous rails by welding or otherwise joining together the ends of the adjacently spaced rail sections, forming a structure sometimes referred to as continuous welded rail track. The technology associated with the construction of CWR track is well known in the prior art.

Because all of the rail sections of continuous rail track are connected, continuous rail track can be particularly sensitive to fluctuations in the ambient temperature of the track and surrounding environment, such as seasonal variations in the ambient temperature resulting in variations in the rail temperature. In tropical climates, the ranges between the temperature extremes are generally moderate, which does not pose a substantial problem for rail systems. In temperate climates, however, such as those in the United States, Asia, Australia and Europe, the ranges of temperature extremes are sufficient to cause catastrophic, temperature induced failures in rail systems, including both rail pull-apart and track-buckle failures, as hereinafter described.

For example, an unanchored 100-mile length of continuous rail in certain areas of a temperate climate could experience a change in length of over 600 feet from one seasonal temperature extreme to the other. By anchoring the rail to railroad ties, changes in the overall length of the rail can be largely prevented but, instead, resultant localized longitudinal stresses are created internally in the rail.

As the rail segments of CWR track are initially installed and anchored to a road bed, each of the rails has zero longitudinal stress. The temperature at which the continuous rail track is installed is sometimes referred to as the rail neutral temperature ("RNT").

As the ambient rail temperature falls below the RNT, tensile longitudinal stresses are created internally in each rail segment of the continuous rail track due to the greater thermal coefficient of expansion of the metal rails relative to that of the underlying roadbed. If the difference between the reduced ambient rail temperature and the RNT is extreme, the tensile stresses in the rails can potentially attain sufficient magnitude to actually cause rail segments in one or both continuous rails to pull apart. Fortunately, pull-apart failure can easily be detected by establishing an electrical track circuit using the rails as part of the conduction path, which becomes "open" if one of the rails of the continuous rail track pulls apart.

Likewise, as the ambient rail temperature climbs above the RNT, compressive stresses are created internally in each of the rails of the continuous rail track. If the difference between the elevated ambient rail temperature and the RNT is extreme, the compressive stresses in the rails can potentially attain sufficient magnitude to actually cause the track panel to buckle. The compressive stress required to cause any particular rail to buckle depends on a number of factors, including the absolute temperature, the difference between the ambient rail temperature and the RNT, and the condition of the ballast, for example.

Such buckling, previously considered random and unpredictable, is a major source of derailments. The ability of a train to negotiate a lateral track panel displacement, which is typical of track-buckle, is minimal. As a result, track-buckle poses a substantially greater risk of derailment than does a rail pull-apart since the former cannot be detected by a conventional track circuit.

Although various methods, systems and apparatus have been developed to measure and/or determine longitudinal stresses in a rail of a continuous rail track, none of them have been used to accurately determine whether a section of continuous rail track is within specific safety limits. Consequently, there is a need for systems and methods that address the shortcomings of prior art rail stress identification and provide a more accurate determination of rail performance within prescribed safety ranges.

SUMMARY OF THE INVENTION

The following provides a summary of exemplary embodiments of the present invention. This summary is not an extensive overview and is not intended to identify key or critical aspects or elements of the present invention or to delineate its scope.

In accordance with one aspect of the present application, an example method is disclosed for determining rail safety limits. The example method includes determining a target rail neutral temperature for a portion of continuous welded rail. The method also includes monitoring a longitudinal stress for the portion of continuous welded rail and monitoring an ambient rail temperature for the portion of continuous welded rail. The method further includes determining a present rail neutral temperature based on the longitudinal stress and the ambient rail temperature. According to the example method, the present rail neutral temperature is compared to the target rail neutral temperature to determine whether a failure of the portion of continuous welded rail has occurred, and an alert is reported if the difference between the present rail neutral temperature and the target rail neutral temperature is within a predetermined range. An example apparatus is also disclosed for performing the method.

In accordance with a second aspect of the present application, an example method is disclosed for determining rail safety limits. The example method includes monitoring an ambient rail temperature for a portion of continuous welded rail, and monitoring a longitudinal stress for the portion of continuous welded rail. The method also includes determining a rail neutral temperature for the portion of continuous welded rail and determining a yield strength of a ballast supporting the portion of rail. The method further includes determining a high temperature buckling threshold associated with the portion of rail. The high temperature buckling threshold is a function of the yield strength, the rail neutral temperature and the longitudinal stress for the portion of the rail. According to the example method, the ambient rail temperature is compared to the high temperature buckling threshold to determine a temperature difference, and an alert is reported if the temperature difference is within a predetermined range. An example apparatus is also disclosed for performing the method.

In accordance with a third aspect of the present application, an example system is disclosed for monitoring rail portions. The system includes a plurality of rail portion stress monitoring devices, and at least one receiver in communication with the plurality of rail stress monitoring devices. The receivers are operative to receive rail stress data from the rail stress monitoring devices. The receivers are further operative to transmit the rail stress data to a rail stress processing apparatus. The rail stress processing apparatus is in communication with the receivers, and is operative to evaluate rail stress data. The rail stress monitoring apparatus is further operative to report alerts based on the rail stress data.

In accordance with a fourth aspect of the present application, an example rail stress monitoring system is disclosed. This system includes a sensor module that further includes a sensing device that is adapted to be mountable directly on a length of rail. The sensing device further includes a generally flat metal shim, and at least one, and typically two, sensors mounted on one side of the shim. The sensors are typically strain gauges, which are mounted on the shim in a specific, predetermined so-called "herringbone" configuration. At least one data acquisition module is in electric communication with the sensing device, and a data processing module receives and processes information gathered by data acquisition module.

Additional features and aspects of the present invention will become apparent to those of ordinary skill in the art upon reading and understanding the following detailed description of the exemplary embodiments. As will be appreciated, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
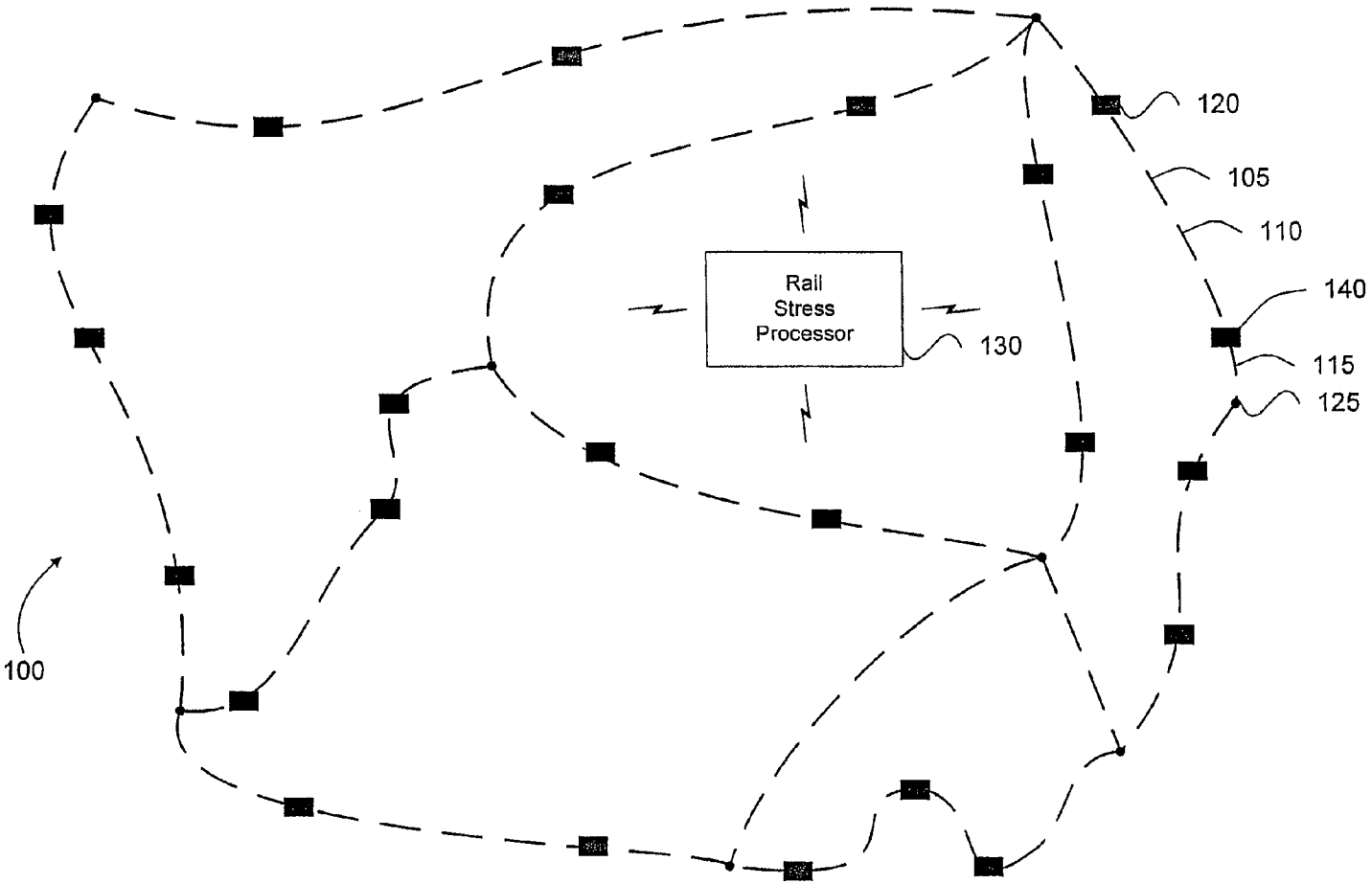
FIG. 1 is a schematic diagram illustrating an example network of continuous rail track, in accordance with the systems and methods described in the present application.

Exemplary embodiments of the present invention are now described with reference to the Figures. Reference numerals are used throughout the detailed description to refer to the various elements and structures. For purposes of explanation, numerous specific details are set forth in the detailed description to facilitate a thorough understanding of this invention. It should be understood, however, that the present invention may be practiced without these specific details. In other instances, well-known structures and devices are shown in block diagram form for purposes of simplifying the description.

Referring to FIG. 1, a schematic diagram illustrates an example network 100 of continuous rail track. The illustrated continuous welded rail track network 100 includes a plurality of CWR track portions, such as rail portions 105, 110, and 115, for example. The CWR track portions create paths between certain nodes, such as the path between nodes 120 and 125. Certain of CWR track portions, such as rail portion 115, for example, include a rail stress-monitoring device such rail stress monitoring device 140. Each rail stress-monitoring device is designed to measure or otherwise determine an amount of internal stress within a rail portion and report such internal stress to a rail stress processor 130.

Figure 2:
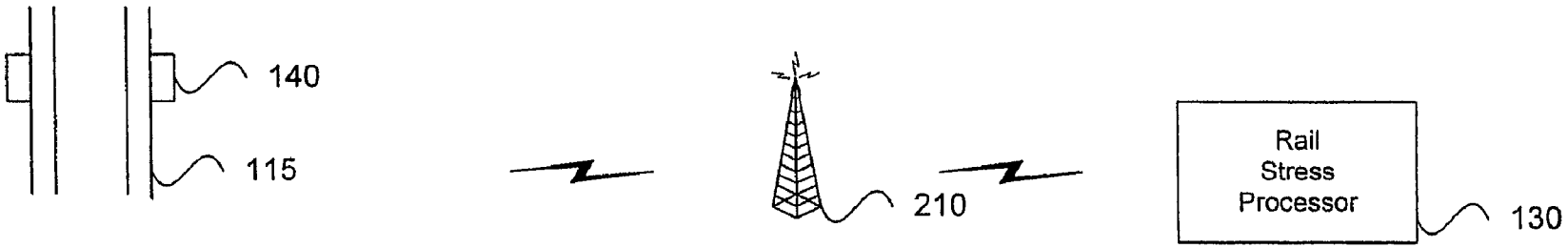
FIG. 2 is a schematic diagram illustrating example communication between certain components of FIG. 1.

Referring now to FIG. 2, there is illustrated a more detailed view of certain components of continuous rail track network 100. As shown, rail stress monitor 140 corresponding to rail portion 115 determines the internal stress of rail portion 115 and transmits the rail stress data to rail stress processor 130 via signaling tower 210.

Of course, the illustrated communications means is merely one example of a variety of ways for rail stress monitors such as monitor 140 to communicate with rail stress processor 130. Examples of other communications means include direct wired communication, satellite, microwave, cellular, any other form of wireless communication, and communication over the Internet, for example. Examples of still other means for communicating monitored data from monitor 140 to rail stress processor 130 include transmission via rail vehicle and manual collection of data from monitor 140 by railway personnel in conjunction with subsequent manual input of such data to rail stress processor 130.

Data collected and reported by monitor 140 includes measured longitudinal stress of a CWR track portion or CWR track panel Other data that may be collected and reported by monitor 140 includes ambient rail temperature, rail temperature, date, time, vibration and RNT, for example.

Figure 3:
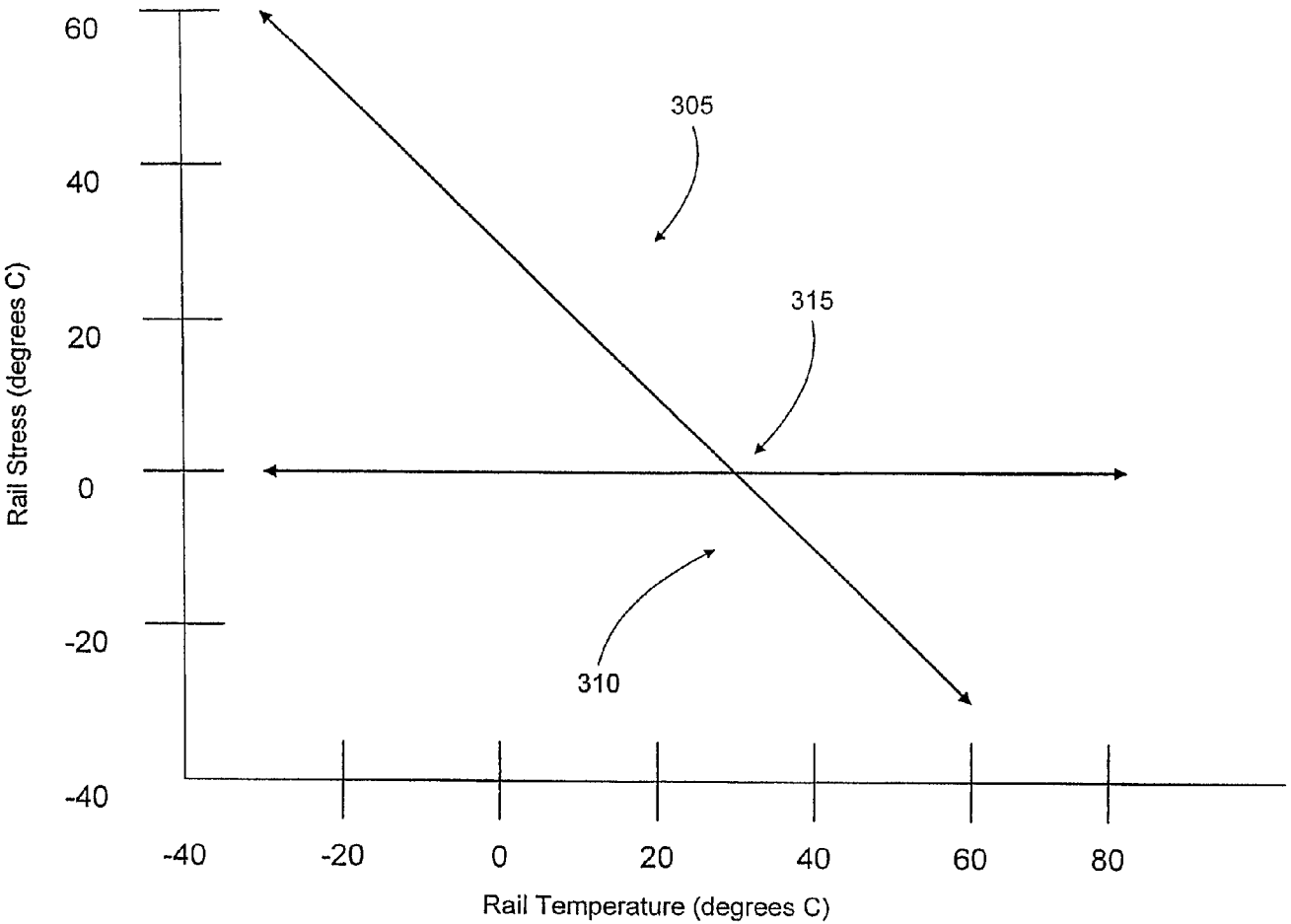
FIG. 3 is a graph illustrating the relationship of longitudinal rail stress to the temperature difference between rail neutral temperature and ambient rail temperature.

Referring now to FIG. 3, there is an example graph illustrating the relationship of longitudinal rail stress to the temperature difference between RNT and ambient rail temperature. As illustrated, the graph charts rail temperature in degrees Celsius along the horizontal axis, and a corresponding rail stress representation in degrees Celsius along the vertical axis. Although rail stress is typically represented in units such as pounds per square inch, for example, the present application recognizes that representing rail stress in terms of degrees greatly simplifies comprehension of the relationships among rail stress, ambient rail temperature and RNT. According to the graph of FIG. 3, rail stress in degrees Celsius can be determined according to the following formula:

Let:

RS=Rail Stress (in degrees Celsius)

RNT=Rail Neutral Temperature (in degrees Celsius)

AT=Ambient rail temperature (in degrees Celsius)

$$RS=RNT-AT$$

In other words, the rail stress charted by the graph of FIG. 3 is that rail stress (RT) is the number of degrees that the ambient rail temperature (RT) is away from the rail neutral temperature (RNT). This linear relationship is depicted at reference numeral 350. The horizontal function depicted at reference numeral 360 represents the stress of an unconstrained portion of rail. Due to the unconstrained state of the rail portion, regardless of the ambient rail temperature, the rail stress is zero. In other words, the RNT of an unconstrained rail is always equal to the ambient rail temperature.

In region 305 of the illustrated example, where the rail temperature is below its RNT, the rail is under tensile stress which tends to result in pull-apart rail failures. The rail stress in the region 310, above its RNT, represents a compressive rail stress which tends to result in track buckle failures. By definition, RNT 315 can be determined using the graph by identifying the point at which there is zero rail stress. On the illustrated graph, the RNT 315 for the example CWR track equals 30 degrees Celsius.

Figure 4:
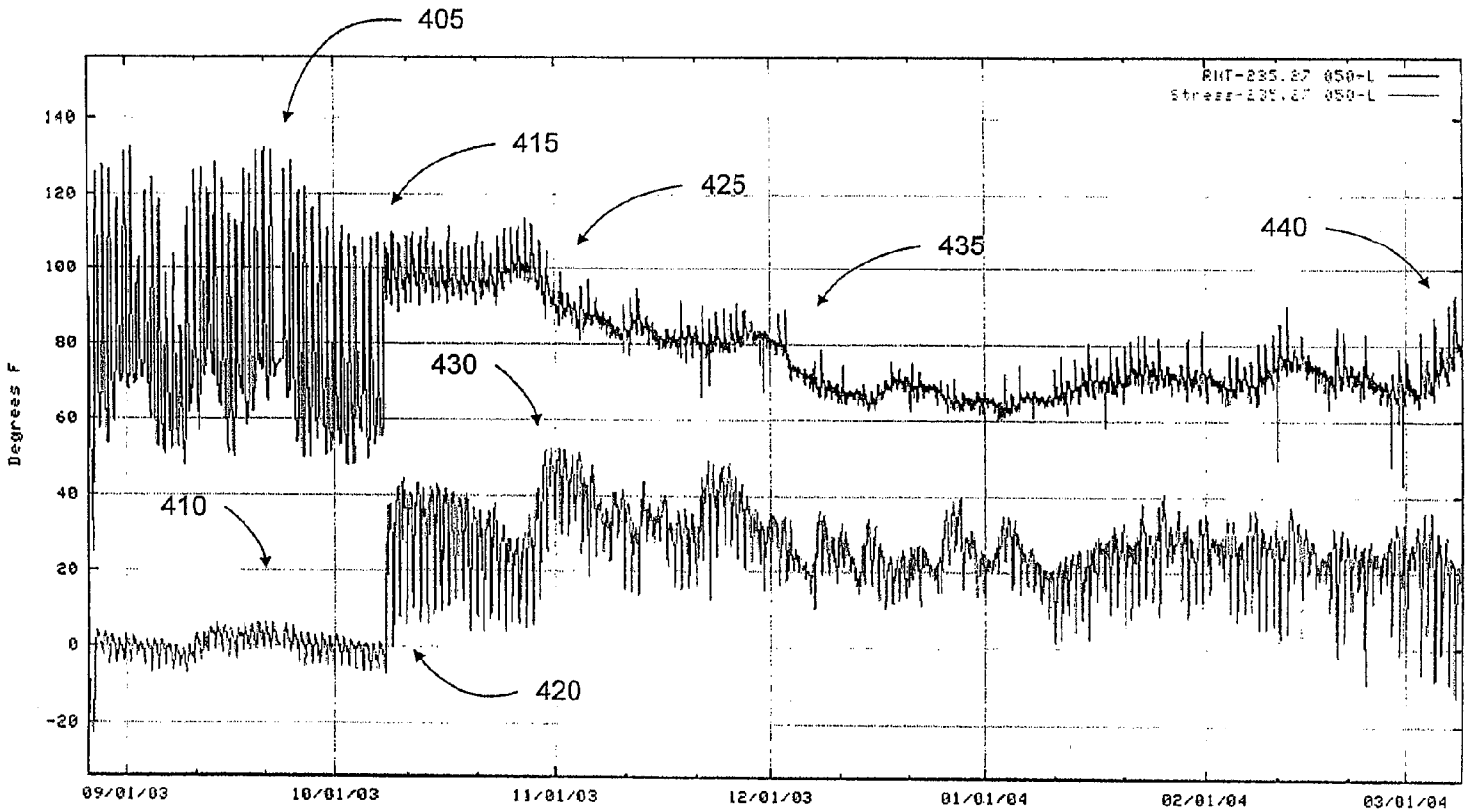
FIG. 4 is a graph of longitudinal stress and RNT for a CWR track panel.

Referring now to FIG. 4, there is illustrated a graph charting RNT and longitudinal stress, in degrees Fahrenheit of a CWR track panel over time. The first portion of the graph, as indicated by reference numerals 405 and 410, represents readings taken prior to securing the CWR rail to the rest of the track. As illustrated, the RNT fluctuates with the ambient rail temperature of the rails throughout each day. Similarly illustrated, the monitored stress in degrees Fahrenheit, also expressed as the difference between the ambient rail temperature and the RNT, is zero. These readings indicate that there is no longitudinal stress on the CWR track panel, which is consistent with the unconstrained condition of the CWR rails prior to installation.

At reference numeral 415, the point at which the CWR rail is constrained, there is illustrated a more constant reading of RNT at approximately 100 degrees. Similarly, at reference numeral 420, the graph depicts a sharp increase in the amount of peak nighttime longitudinal rail stress that remains constant at approximately 30 to 40 degrees for some time. This sudden increase and positive (tensile) rail stress value is consistent with welding the two rail ends together and re-anchoring the rail to the cross ties. The resultant loads are transferred to the ballast leaving the rail in a fully constrained condition.

At reference numeral 430, there is depicted a sharp increase in longitudinal rail stress, and a corresponding decrease in the RNT at reference numeral 425. In theory, once the CWR track panel is constrained, the RNT should remain constant for the life of the CWR track panel. In practice, however, a number of factors may affect the RNT. Some changes in the RNT may be temporary, while others may be permanent. For example, the ballast supporting a CWR track panel may adjust over time, causing the CWR track panel to shift or otherwise change its position. Such an adjustment, typically due to entropy and/or other natural forces, may relieve the CWR track panel of stress. The reduced level of stress affects the RNT for as long as the CWR track panel remains in the shifted position.

At reference numeral 425, the graph illustrates a drop in RNT to approximately 80 degrees Fahrenheit, and it fails to rebound back to 100 degrees Fahrenheit for the remainder of the monitored duration. Such fluctuations in RNT over time may represent plastic or elastic changes in the rail portion. Generally, shifting of rail and ties in the ballast is the primary source of loss of RNT. Realigning the track panel or removing segments of rail locally are necessary to recover the proper RNT.

At reference numeral 435, it appears as though some factor affected the monitored RNT of the CWR track panel. From the data provided, it is unclear whether the change in RNT at 435 was a plastic or elastic change. From the data provided (a curve with a one percent grade), the change in RNT at 435 was shrinking of the curve radius by ties shifting in the ballast. The resultant increase in RNT at 440 appears to be from migration of the rail downhill and some compression loads as the ambient temperatures increase. Of course, the changes at 435 and 440 could have been unrelated elastic changes that simply happen to be in opposite orientations.

Monitoring of longitudinal stress levels alone does not provide the same breadth of information regarding the state of any particular CWR track panel. The predictive and/or preventative advantages of the present invention are derived through the collection and/or analysis of the longitudinal stress, ambient rail temperature, RNT, and in some cases the ballast conditions. Analysis of these data enable prediction of maintenance conditions, or so-called "soft" failures, and safety conditions or so-called "catastrophic" failures.

Figure 5:
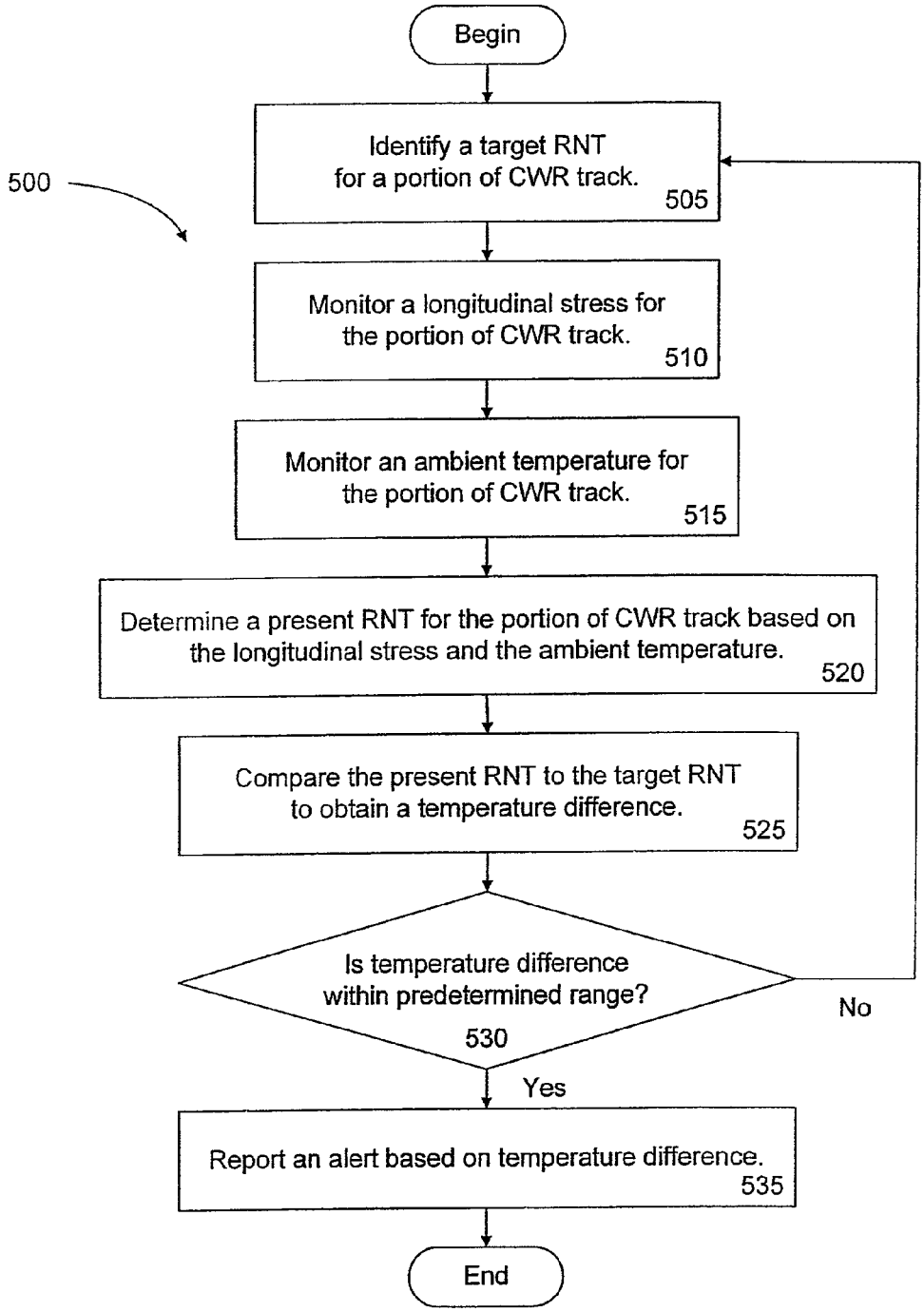
FIG. 5 is a flow chart illustrating a first example methodology for determining rail safety limits.

FIG. 5 is a flowchart illustrating a first example methodology 500 for a rail stress processing apparatus to determine rail safety limits for each rail portion of a continuous welded rail track, such as the CWR track 105 of rail system 100. According to the example methodology, at block 505 a target RNT is identified for a particular portion of a continuous rail. The longitudinal stress of the rail portion is monitored at block 510, and the ambient rail temperature of the rail portion is monitored at block 515. In the example rail network 100 illustrated in FIG. 1, such longitudinal stress and ambient rail temperature are monitored by rail monitoring device 140 and transmitted to the rail stress processor 130. Using the ambient rail temperature and the longitudinal stress of the rail portion, a present RNT is determined at block 520 given the relationship illustrated in FIG. 3.

The methodology provides at block 525 that the present RNT is compared to the target RNT to obtain a temperature difference, which may be indicative of a track buckle or other failure. If the temperature difference is within a predetermined range (block 530), an alert is reported (block 535) indicating a potential safety issue associated with the predetermined range. Of course, a predetermined range could be defined as an open-ended range, such that when the temperature difference exceeds or otherwise crosses a predetermined threshold, the temperature difference is said to be within the predetermined range. Such a predetermined threshold value could further be crossed in either a positive or a negative direction.

Figure 6:
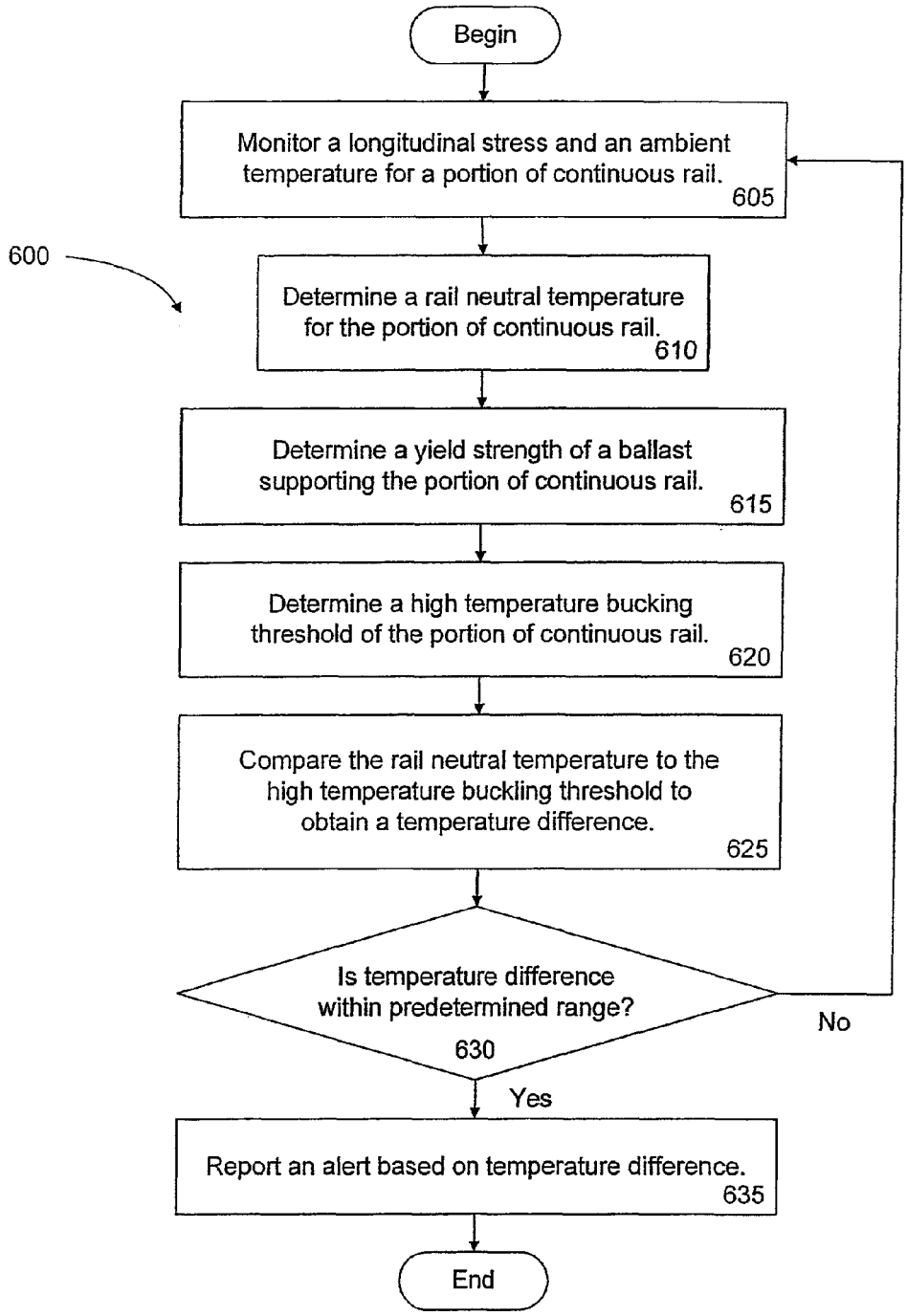
FIG. 6 is a flow chart illustrating a second example methodology for determining rail safety limits.

FIG. 6 is a flowchart illustrating a second example methodology 600 for a rail stress processing apparatus to determine rail safety limits for each rail portion of a continuous welded rail track, such as the CWR track 105 of rail system 100. According to the example methodology, at block 605 a longitudinal stress and an ambient rail temperature is monitored or otherwise determined for a particular portion of a continuous rail. In the example rail network 100 illustrated in FIG. 1, such longitudinal stress is monitored by rail monitoring device 140 and transmitted to the rail stress processor 130. The rail neutral temperature of the rail portion is determined at block 610 using the ambient rail temperature and the longitudinal stress of the rail portion, given the relationship illustrated in FIG. 3.

At block 615, a yield strength is determined for a ballast supporting the continuous rail portion, and at block 620, a high temperature buckling threshold is determined based on the data collected at blocks 605, 610 and 615. The high temperature-buckling threshold may be determined according to a mathematical function of such data or based on a lookup table using the data collected at blocks 605, 610 and 615 as an index into the table. The lookup tables may be populated based on historical rail failure data collected under the specific conditions associated with the indices. The methodology provides at block 625 that the RNT is compared to the temperature-buckling threshold to obtain a temperature difference. If the temperature difference is within a predetermined range (block 630), an alert is reported (block 635) indicating a potential safety issue associated with the predetermined range.

Accordingly, the present application describes methods, apparatus and systems for determining the safe limit of CWR track based on temperature and rail stress. By observing the current rail neutral temperature, ambient rail temperature and the longitudinal stress in the rail, a yield strength of the ballast holding the track panel can be determined, particularly in curves. By observing this yield strength over various conditions and with the aid of analytical models, the yield stress or an adjusted proportion of same can be added to RNT to establish a high temperature buckling threshold for purposes of signaling maintenance work or changes in train operations until said conditions are alleviated. Examples of analytical models that may be employed include models provided by a track operating manual, models created based on actual track measurements over time, and mathematical models, such as models created by the U.S. Department of Transportation.

Factors potentially influencing the yield strength of track panel within ballast include: curvature, superelevation, ballast type and condition, ballast shoulder width, eccentricity of rail alignment, tie size, weight and spacing. By this method, nearly all these factors are accommodated within the observed behavior in a manner not economically duplicated by other means. As described, a lookup table with track curvature and other easily known factors may be employed to tune the safety margin to an acceptable level for a railroad's standard practices.

Figure 7:
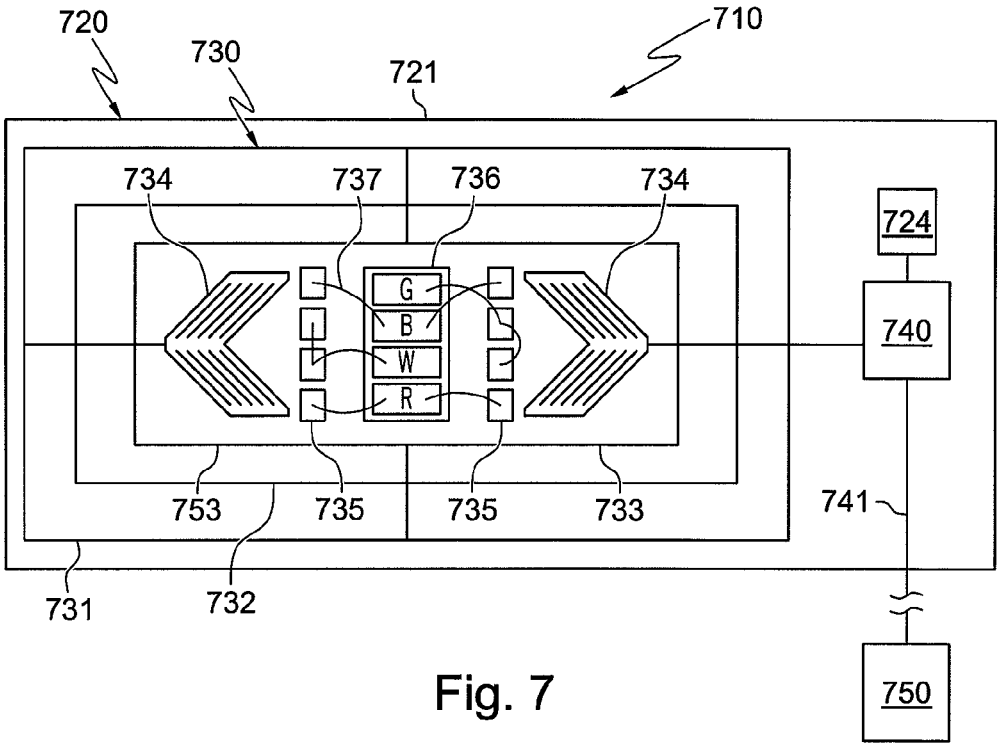
FIG. 7 is both generalized schematic of an exemplary embodiment of the system for monitoring rail stress of the present invention and a generalized top view of internal components of the sensing device of the present invention.
Figure 8:
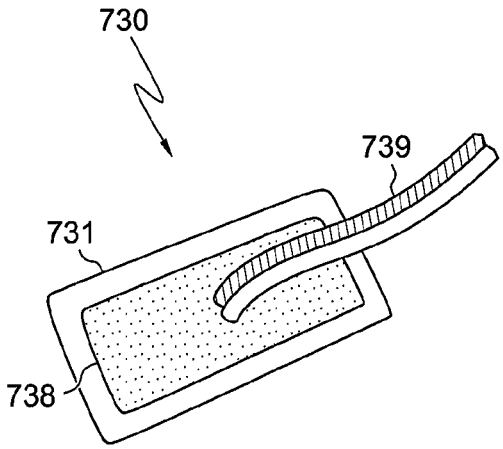
FIG. 8 is a perspective view of an exemplary embodiment of an assembled version of the sensing device of the present invention.
Figure 9:
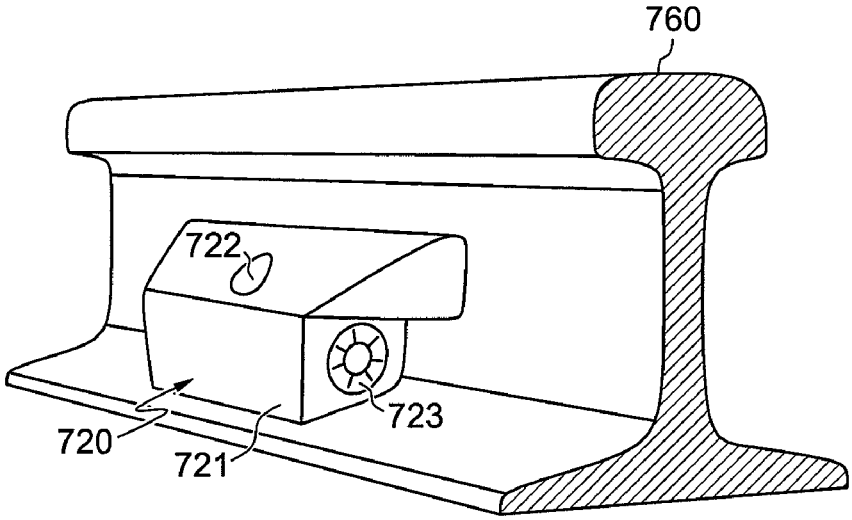
FIG. 9 is a perspective view of a length of rail upon which an exemplary embodiment of the sensor module of the present invention has been mounted.

Referring now to FIGS. 7-10, various components and sub-components of the rail stress monitoring system of the present invention are illustrated. As shown in FIG. 7, an exemplary embodiment of rail stress monitoring system 710 includes, in electrical and/or digital communication with one another, a sensor module 720, a sensing device 730, a data acquisition module 740, and a data processing module 750. As shown in FIG. 9, sensor module 720 is typically mounted directly on a length of rail 760, and includes a protective housing 721 and a rail fastener 722 for securing the sensor module 720 to the rail. A cover 723 may be removed for the purpose of accessing an internal power supply 724, which is typically a battery. Accessing the internal power supply in this manner makes removing the entire sensor module 720 from the rail unnecessary.

In the exemplary embodiment, sensing device 730, which is referred to as a "thin-film flex circuit", is utilized to detect, measure, and monitor stress, i.e., biaxial strain, that is experienced by rail 760 under certain environmental conditions. Such stress is detected and measured by two sensors 734, which are mounted, using epoxy or other means, on a generally flat, thin metal shim 731, thereby defining a sensing region 733 on shim 731. In an exemplary embodiment, shim 731 is about one inch (2.54. cm) in length and about 0.5 inches (1.27 cm) in width and includes relatively heavy metal (e.g., tin) foil. In addition to sensors 734, which are typically strain gauges, some embodiments of this invention include additional, different sensing devices such as temperature sensors. A perimeter 732 may be defined on shim 731, and a rubberized material may be included to provide a protective covering over the entire sensing region 733. FIG. 8 provides an illustration of an assembled sensing device 730 that includes a protective covering 738.

In the exemplary embodiment, sensors 734 are commercially available strain gauges (Hitec Products, Inc., Ayer, Mass.), each of which includes two active sensing elements set at right angles to one another (see FIG. 7) to form a symmetrical sideways "V" pattern referred to as a "herringbone" configuration. As shown in FIG. 7, the open ends of the two v-shaped sensors face one another on shim 731 and are oriented orthogonally to the strains of interest, i.e., the strains experienced in the field by rail 760. As will be appreciated by those skilled in the art, there are often difficulties with transferring strain through a thin shim stock material. In particular, compression strains can cause local buckling of the shim causing the strain to be somewhat different than the parent structure. This is generally not an issue with a uniaxial gauge, whereby the long axis of the coupon is in the same direction as the sensing element. By using a herringbone configuration and orienting the sensing elements orthogonally to the strains of interest, the shim is generally placed in shear and presumably has a more correct response to biaxial strains.

Solder pads 735 and main lead wire attachment pads 736 are mounted on shim 731 in a space located between the two sensors. A series of sensor wires 737 connect solder pads 735 to the main lead wire attachment pads 736, the placement of which permits lead wires 739 to be attached to the center portion of the sensing device. The wiring configuration of the exemplary embodiment "daisy chains" the four sensing elements into a loop, and that loop becomes a Wheatstone bridge. As will be appreciated by the skilled artisan, a Wheatstone bridge is an electrical circuit used to measure resistance. A Wheatstone bridge typically consists of a common source of electrical current (such as a battery) and a galvanometer that connects two parallel branches containing four resistors, three of which are known. One parallel branch contains a resistor of known resistance and a resistor of unknown resistance; the other parallel branch contains resistors of known resistance. To determine the resistance of the unknown resistor, the resistance of the other three resistors is adjusted and balanced until the current passing through the galvanometer decreases to zero. The Wheatstone bridge is also well suited for measuring small changes in resistance, and is therefore suitable for measuring the resistance change in a strain gauge, which transforms strain applied to it into a proportional change of resistance. In conventional terminology, the bridge terminals in the exemplary embodiment are designated as Red (+input power), Black (−input power), Green (+output signal), and White (−output signal).

Sensor module 720 may be mounted on rail 760 according to the following exemplary method: select a general spot on the rail where mill marks and other pre-existing items or structures are avoided; mount a rail drill or other drilling device on rail 760 and create a bolt hole at a predetermined height; grind/polish a spot on rail 60 where sensing device 730 will be placed; spot weld or otherwise attach sensing device 730 to rail 760 using a template that precisely locates sensing device 30 relative to the bolt hole and that provides both proper orientation relative to the rail's neutral axis, and orthogonality of the sensing elements; apply a waterproofing material (e.g., an RTV silicone material) over sensing region 733; and while carefully avoiding any straining of lead wires connecting sensing device 730 to data acquisition module 740, mount the protective housing 721 such that a fastener assembly can be fitted and tightened. As will be appreciated by the skilled artisan, other attachment or mounting means are possible for use with sensor module 720 and the components thereof. For example, in other embodiments, a composite shim is bonded to rail 760 using a quick-setting adhesive or other adhesive means.

Figure 10:
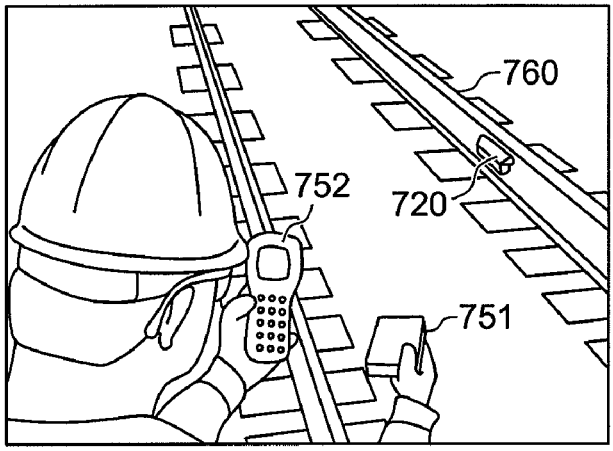
FIG. 10 is a stylized illustration of a technician taking readings from an exemplary embodiment of the sensor module of the present invention.

When sensor module 720 is assembled, sensing device 730 is connected to a data acquisition module 740, which collects data generated by sensing device 730 when system 710 is operating. As will be appreciated by the skilled artisan, data acquisition module 740 typically includes a circuit board or similar device typically constructed from off-the-shelf, commercially available components, although for some applications custom-built devices may be used. A transmitting means, i.e., antenna 741 is connected to, or is otherwise in communication with, the circuit board, and sends radio frequency signals to a data processing module 750, which is usually located remotely from sensor module 720. As shown in FIG. 10, data processing module 750 may include a custom designed reader/interrogator device 751 that utilizes various technologies known in the art. In the exemplary embodiment, reader/interrogator device 751 interacts with sensor modules 720, relays data to one or more databases, and communicates with an optional, additional processing device 752 when a technician or other user of system 710 is monitoring stress or other conditions experienced by rail 760. Optional processing device 752 typically uses wireless means to communicate with reader/interrogator device 751 and may include an integrated image display for enhanced functionality.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A system for monitoring rail stress, comprising:

(a) a length of rail, wherein the length of rail is subjected to biaxial strains under certain environmental conditions;

(b) at least one sensing device adapted to detect, measure, and monitor rail stress, wherein the sensing device is mounted directly on the length of rail and further includes:

(i) a flexible, generally flat shim, wherein the shim further includes a sensing region located thereon;

(ii) at least one temperature sensor mounted within the sensing region on the shim;

(iii) first and second strain sensors mounted within the sensing region on the shim, facing one another and defining a space therebetween, wherein the first and second sensors are oriented orthogonally to the biaxial strains experienced by the length of rail, wherein each strain sensor further includes first and second strain sensing elements set at right angles to one another, and wherein the four strain sensing elements in combination with one another form a Wheatstone bridge;

(iv) a first plurality of solder pads mounted on the shim inside the space defined by the first and second strain sensors nearest the first strain sensor;

(v) a second plurality of solder pads mounted on the shim inside the space defined by the first and second sensors nearest the second sensor;

(vi) a plurality of lead wire attachment pads mounted between the first plurality of solder pads and the second plurality of solder pads; and (vii) a plurality of sensor wires connecting the solder pads to the lead wire attachment pads; and (c) at least one lead wire attached to the lead wire attachment pads, wherein the position of the lead wire attachment pads permits the lead wire to be attached to the center portion of the sensing device;

(d) at least one data acquisition module in communication with the at least one sensing device, wherein the sensing device is enclosed within a sensor module, and wherein the sensor module further comprises a protective housing for enclosing the at least one sensing device and the at least one data acquisition module.

2. The system of claim 1, further comprising transmitting means in communication with the at least one data acquisition module for transmitting information to the data processing module.

3. The system of claim 1, wherein the sensor module further comprises a self-contained power supply.

4. The system of claim 1, wherein the at least one sensing device further comprises a protective covering, and wherein the protective covering is deposited over the sensing region.

5. The system of claim 1, wherein the shim is about 1 inch (2.54 cm) in length, about 0.5 inches (1.27 cm) in width, and further comprises metal foil.

6. The system of claim 1, further comprising a data processing module, wherein the data processing module receives and processes information gathered by the at least one data acquisition module to determine rail stress.

7. The system of claim 6, wherein the data processing module further comprises a hand-held reader and a hand-held data processor.

8. The system of claim 7, wherein the hand-held reader and the hand-held data processor are integrated into a single hand-held unit.

* * * * *